United States Patent [19]

Goldish

[11] Patent Number: 5,033,460

[45] **Date of Patent: * Jul. 23, 1991**

[54] GRAVITY LUMBAR TRACTION DEVICE AND TREATMENT METHOD

[75] Inventor: Gary D. Goldish, Golden Valley, Minn.

[73] Assignee: Regents of the University of Minnesota, Minneapolis, Minn.

[ * ] Notice: The portion of the term of this patent subsequent to Jan. 30, 2007 has been disclaimed.

[21] Appl. No.: 469,192

[22] Filed: Jan. 24, 1990

Related U.S. Application Data

[63] Continuation-in-part of Ser. No. 91,845, Sep. 1, 1987, Pat. No. 4,896,659, which is a continuation-in-part of Ser. No. 922,665, Oct. 24, 1986, abandoned.

[51] Int. Cl.[5] ..... A61H 1/02

[52] U.S. Cl. ..... 128/75; 128/78

[58] Field of Search ..... 128/75, 78; 272/112, 272/119, 120, 121, 116, 134, 139, 143, 70, 70 A, 109

[56] References Cited

U.S. PATENT DOCUMENTS

| | | | |
|---|---|---|---|
| 339,650 | 4/1886 | Hill | 272/70 A |
| 1,347,913 | 7/1920 | Rink | 128/75 |
| 2,812,010 | 11/1957 | Abdallah | 272/70 A |
| 3,167,068 | 1/1965 | Carr | 128/75 |
| 3,548,817 | 12/1970 | Mittasch | 128/75 |
| 3,896,798 | 7/1975 | Simon . | |
| 3,926,183 | 12/1975 | Spiro | 128/78 |
| 3,937,461 | 2/1976 | Lew | 272/109 |
| 4,099,523 | 7/1978 | Lowrey | 128/78 X |
| 4,099,524 | 7/1978 | Cuemar et al. | 128/78 |
| 4,205,665 | 6/1980 | Burton . | |
| 4,269,179 | 5/1981 | Burton . | |
| 4,372,552 | 2/1983 | Carlmark . | |
| 4,396,012 | 8/1983 | Cobiski . | |
| 4,422,452 | 12/1983 | Burton | 128/75 |
| 4,431,184 | 2/1984 | Lew et al. | 272/109 |
| 4,524,763 | 6/1985 | Eberling . | |
| 4,569,340 | 2/1986 | Burton . | |
| 4,896,659 | 1/1990 | Goldish | 128/78 X |

FOREIGN PATENT DOCUMENTS 220557 10/1967 Sweden .

OTHER PUBLICATIONS

Article in Publication "Braces Today", Oct. 1957.

*Primary Examiner*—Richard J. Apley
*Assistant Examiner*—Linda C. M. Dvorak
*Attorney, Agent, or Firm*—Kinney & Lange

[57] ABSTRACT

A support that uses gravity and the patient's own body weight to produce traction for lumbar reduction is in the form of a vest worn around the patient's chest and including weight supporting arm rests attached to the vest, so the elbows and forearms can be rested thereon to partially support the patient's weight. The weight supported through the arms relieves part of the load on the ribs and trunk of the patient. The support is low cost and means for supporting it comprises an overhead cross bar such as the commonly used chinning bar that is supported in a doorway at a height adjusted so the patient can touch the floor with his toes and adjust the weight supported through the vest, as well. The support is through overhead straps which are arranged to provide laterally inward forces to urge the vest sections toward the body of a user.

21 Claims, 8 Drawing Sheets

GRAVITY LUMBAR TRACTION DEVICE AND TREATMENT METHOD

BACKGROUND OF THE INVENTION

The application is a continuation-in-part of my copending application Ser. No. 07/91,845 filed Sept. 1, 1987 now U.S. Pat. No. 4,896,659 which in turn was a continuation-in-part of my application Ser. No. 922,665 filed Oct. 24, 1986, for an Upright Gravity Lumbar Traction Device, now abandoned.

The present invention relates to patient supports for providing gravity traction and therapeutic manipulation to the lumbar spine.

The advantages of gravity induced lumbar reduction have been recognized, and such treatment has been advanced by Dr. Charles V. Burton, the inventor of U.S. Pat. No. 4,205,665, issued Jul. 3, 1980; U.S. Pat. No. 4,269,179, issued May 26, 1981; and U.S. Pat. No. 4,422,452, issued Dec. 27, 1983. The basic concept of gravity lumbar reduction is the use of gravity and the patient's own body weight to produce traction. Traction in gravity lumbar reduction, as shown in the abovementioned patents, is provided by hanging the patient on a tilt table through suspension straps attached to a vest worn around the patient's chest. The tilt table framework permits varying the force of traction by varying the inclination of the table and the patient. When the patient is upright, the maximum traction is provided on the lumbar spine. The tilt table requires a supporting framework and is cumbersome, large, and fairly expensive to make. Dr. Burton also has developed vests such as that shown in U.S. Pat. No. 4,569,340.

U.S. Pat. No. 4,269,179 also shows a flexible or nonrigid vest material that is designed to provide a conforming fit around the patient's torso and is used with a tilt table. The vest is supposed to conform to the contour of the patient's rib cage for increased comfort.

Additional developments in relation to traction apparatus of this general type are shown in U.S. Pat. No. 4,524,763, issued Jun. 25, 1985, which utilizes an inclined support board and a vest that goes around the torso of a patient. The board is made on a frame that can be folded.

A vertical traction support belt is shown in U.S. Pat. No. 4,396,012, issued Aug. 2, 1983. The belt has a synthetic rubber material on the inside. The belt fastens around the torso of the patient to support the patient in much the same manner as that disclosed in the previous mentioned Burton patents.

A therapeutic traction apparatus that provides for supporting a patient on horizontal bars is shown in U.S. Pat. No. 3,896,798.

A "hang stand" is shown in U.S. Pat. No. 4,372,552 wherein a patient hangs from an overhead bar for therapy. U.S. Pat. No. 4,396,012 shows another vest type hanging device Swedish Patent No. 220,557 also shows a large lifting girdle with support straps attached directly to the top edge of the girdle.

In each of the vest type and belt type prior art devices, the most frequent adverse affect is chest discomfort, which translates into contraction of the trunk muscles that invariably counteracts force of gravity. Gravity lumbar reduction is also difficult to carry out for those patients with respiratory illness since the support vests act only through the chest. Even in patients that are in general good health, chest compression limits angle of the tilt table and thus the traction force that can be tolerated. Additionally, the costs involved in present gravity lumbar reduction systems are substantial. The vest tilt tables will add considerable expense and make it quite cumbersome, This limits the use of the apparatus.

SUMMARY OF THE INVENTION

The present invention relates to a vest providing upright gravity lumbar traction comprising an outer shell portion that engages the thorax of patient to support weight as needed. Attached to the lateral sides of the vest are arm rests comprising elongated gutters on which the elbows and forearms of the patient can be placed to partially carry the patient's body weight when the vest is suspended. The outer shell of the vest is made so that weight can be transferred to the vest and support troughs and through the vest's supporting straps connections to an overhead support bar. Preferably, the outer shell is made of a light semi-rigid material, such as polypropyle which can be molded to generally follow the contour of the patient's thorax. By following the general contour of the patient's body, a greater portion of the vest contacts the patient's skin, spreading weight out and decreasing pressure concentration, making treatment more tolerable. The outer shell is preferably made open across the chest and back of the patient to allow the chest to expand and so as not to constrict the diaphragm. The support strap arrangement keeps the vest in position for supporting the patient.

The vest is used in connection with a conventional cross bar or chin bar that is supported in a door frame at a desired level. The vest supporting connection comprises shoulder straps that are fixed to the arm rests or gutters. The straps are supported on the top cross bar in a desired manner. The patient is preferably supported at a level allowing the patient's toes to touch the floor to partially support the patient's body weight. The toes can be lifted for supporting the full weight through the vest as desired. The patient's spine can be therapeutically palpitated and manipulated while supported, particularly with the vest having an open back.

A board may be placed between the patient and the support (door) frame at the patient's back or front to vary the angle of support for better positioning of the spine. The patient also may be supported while bent laterally at an angle. Tilting is not needed as with a tilt board, since the patient merely pushes his/her toes to the floor and thus varies the traction force. Additionally, by distributing the patient's weight through the arm rests or supports, the patient's entire weight does not have to be supported through the chest, thereby increasing comfort and permitting the patient to more easily tolerate the treatment. At the same time, there is better relaxation of the trunk muscles because the forces of gravitational traction can be varied by the patient.

The ability to support weight on the feet permits complete interruption of the traction forces and thus permits intermittent traction loads (cycling on and off at desired intervals). The device also permits adding weight to the ankles or pelvis to increase traction forces because the body weight can be distributed across larger skin areas and greater force can be tolerated by the patient.

The entire unit is compact, even including the cross bar or chin up bar, and this makes it much easier to use in a home as well.

DETAILED DESCRIPTION OF THE PREFERRED EMBODIMENTS

Figure 1:
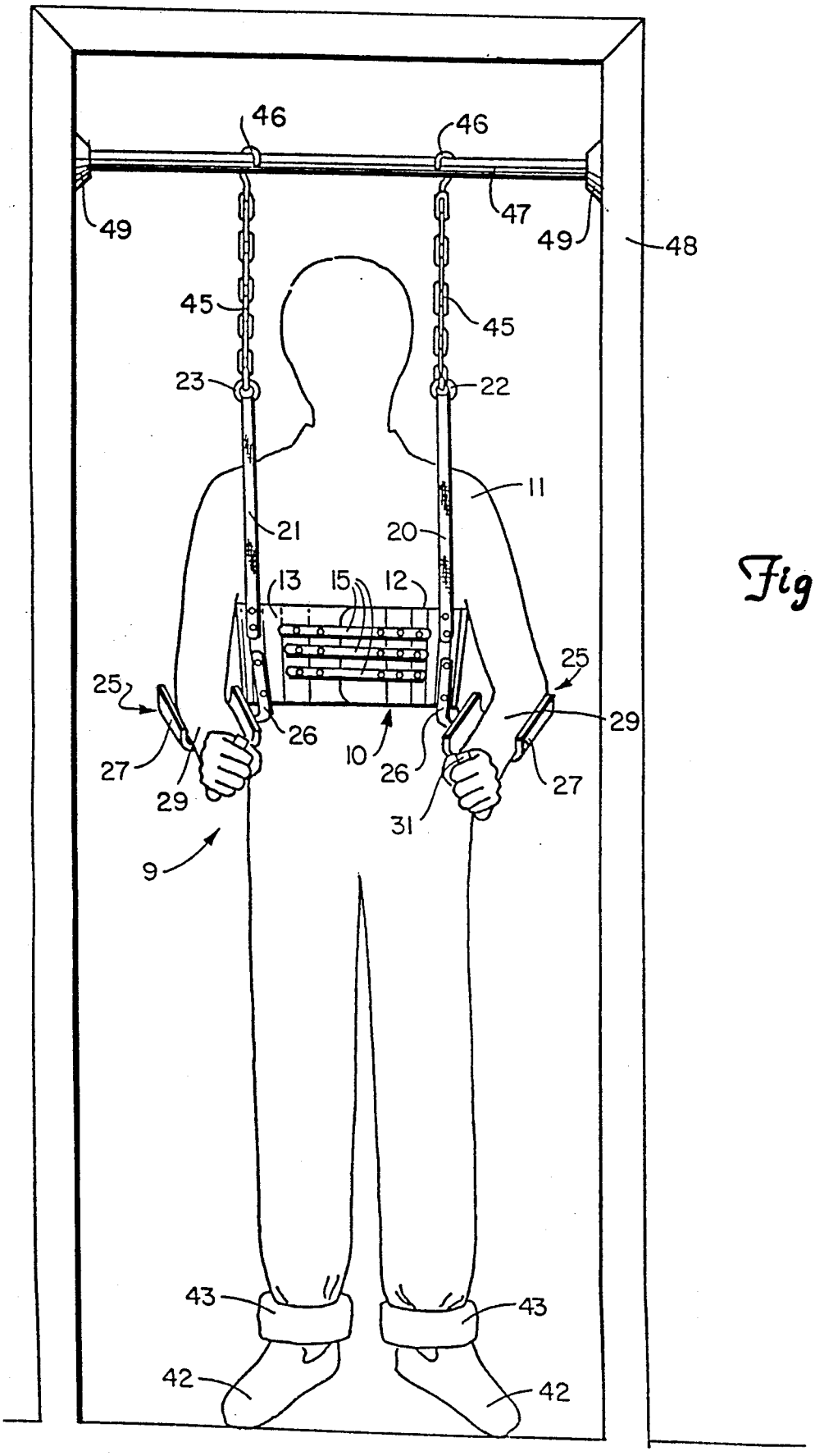
FIG. 1 is a front elevational view of a gravity lumbar traction device made according to a first form of the present invention.
Figure 2:
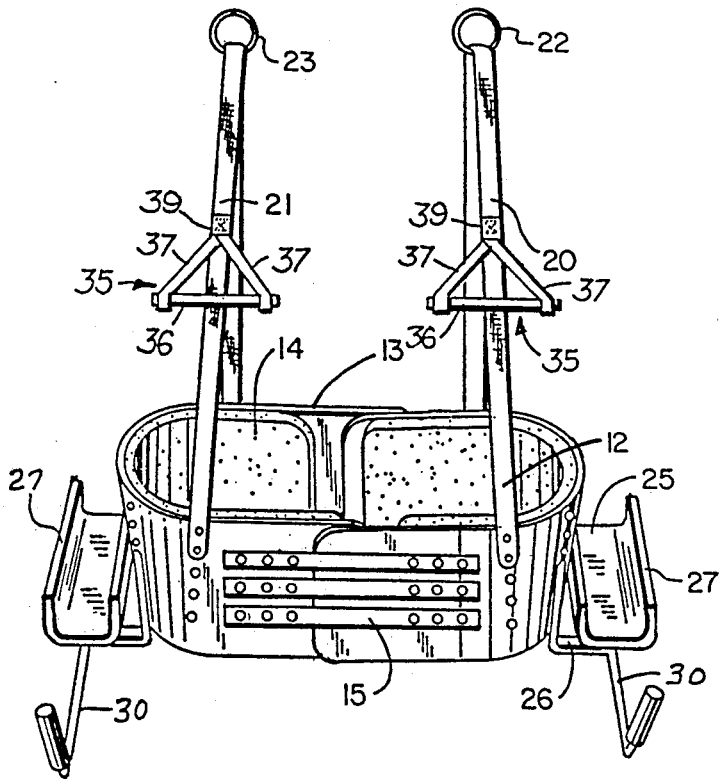
FIG. 2 is a front perspective elevational view of the vest shown in FIG. 1.
Figure 3:
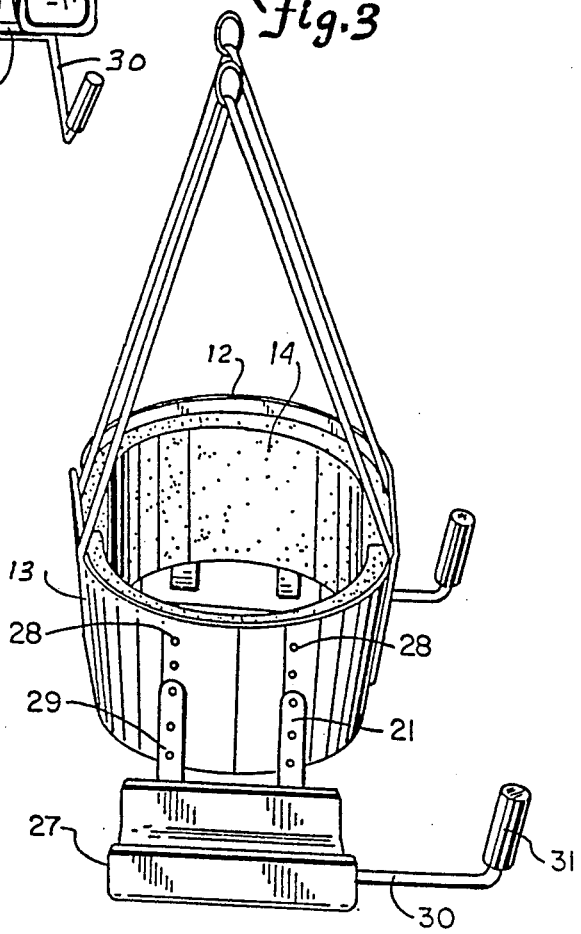
FIG. 3 is a side perspective view of the vest of FIG. 2.

A gravity lumbar traction device made according to a first form of the present invention indicated generally at 9 is shown being worn by a patient or user that is receiving treatment for disorders of the lumbar spine. The apparatus 9 comprises a hard shelled or rigid vest 10, which as shown is made into two shell exterior vest sections 12 and 13, that fit around the sides of the body near the lower portions of the rib cage. A suitable foam liner 14 can be provided on the inside surfaces of the exterior vest sections 12 and 13. The vest sections, as shown in the first form can overlap at the front and rear and telescope slightly to adjust for different size torsos. The vest sections preferably are of semi-rigid or relatively inflexible material such as molded polypropylene.

The two vest sections 12 and 13 are shown fastened together with a plurality of straps or other fasteners shown at 15 that are adjustable as to length. The fasteners 15 are positioned at both the front and back of the vest sections 12 and 13.

Shoulder support straps indicated generally at 20 and 21 are attached to the vest sections 12 and 13, respectively, at both the front and back of each vest section, and support rings 22 and 23 are provided on the straps 20 and 21. The support straps can be attached to other positions on the vest if desired, as well.

Each of the vest sections 12 and 13 is provided with an arm rest or support indicated generally at 25. The arm rests 25 comprise concave troughs 27 which are fixed on suitable brackets 26 -that in turn are fixed to the hard shell vest sections 12 and 13, respectively. The brackets 26 are bolted to the respective vest sections using a set of adjustment holes 28 provided in the vest sections. The troughs 27 are positioned at a level so that when the vest 10 is being worn by a patient, they will comfortably fit under and support the forearm 29 of the patient when the patient's arm is bent at the elbow. The troughs 27 are elongated and are generally perpendicular to the body axis of the patient. In other words, the patient can place his forearms into the support troughs 27 and partially support his weight through the upper arms and shoulders.

As shown, forwardly extending optional frame members 30 with hand grip 31 are fixed to the troughs.

Hand grip handles 35 comprising short bars 36 are supported on a pair of straps 37 (one on each of the hand grips). The straps 37 taper together and are supported on the front portion of straps 20 and 21 by stitching, rivets or similar fasteners at 39.

When a patient is supporting his weight through the upper arms and the shoulders, relaxation of the trunk muscles is more likely and thus the gravity lumbar treatment is more effective.

The rings 22 and 23, on the shoulder straps 20 and 21, are in turn attached to support chains 45, which have hooks 46 on the upper ends thereof that are of size to fit over a chin up or cross bar 47 supported onto a door frame 48 with suitable support members 49. The chin up bar 47 is a standard bar that is used extensively, and is supported on door frames using supports such as those shown at 49, in a conventional manner. The support bars suspended from the ceiling or even ceiling hooks can be used. The chains 45 are adjusted in relation to the height of the chin up bar 47 so that the patient's feet 42 can be moved so the toes touch the floor when the toes are tilted down. The weight of the patient that is supported through the vest, including the support through the arm support members 25, can then be varied or relieved fully by the patient by supporting part of the body weight (or his entire weight) on the floor. Adjustment of height is easy because conventional chains 45 can be adjusted by moving the hooks 46 to different links without any difficulty, utilizing the link lengths for adjustment.

The ability for the patient to support his full weight permits either continuous traction loading for an extended period at full weight or partial weight loading. Further intermittent traction (two minutes load and two minutes no-load, for example) is possible. If desired, weights, such as those shown in dotted lines at 43, may be added to the ankles of a patient by strapping them in place.

The support vest 10 is quite cost efficient because the preferred hard plastic shell can be easily molded, and the interior padding does not have to be as complex or as expensive as that where the ribs alone provide support for the patient's weight and the padding can be eliminated.

Intermittent traction supporting the weight fully for selected periods between traction permits various treatment cycles and can be used to avoid excessive discomfort.

Figure 4:
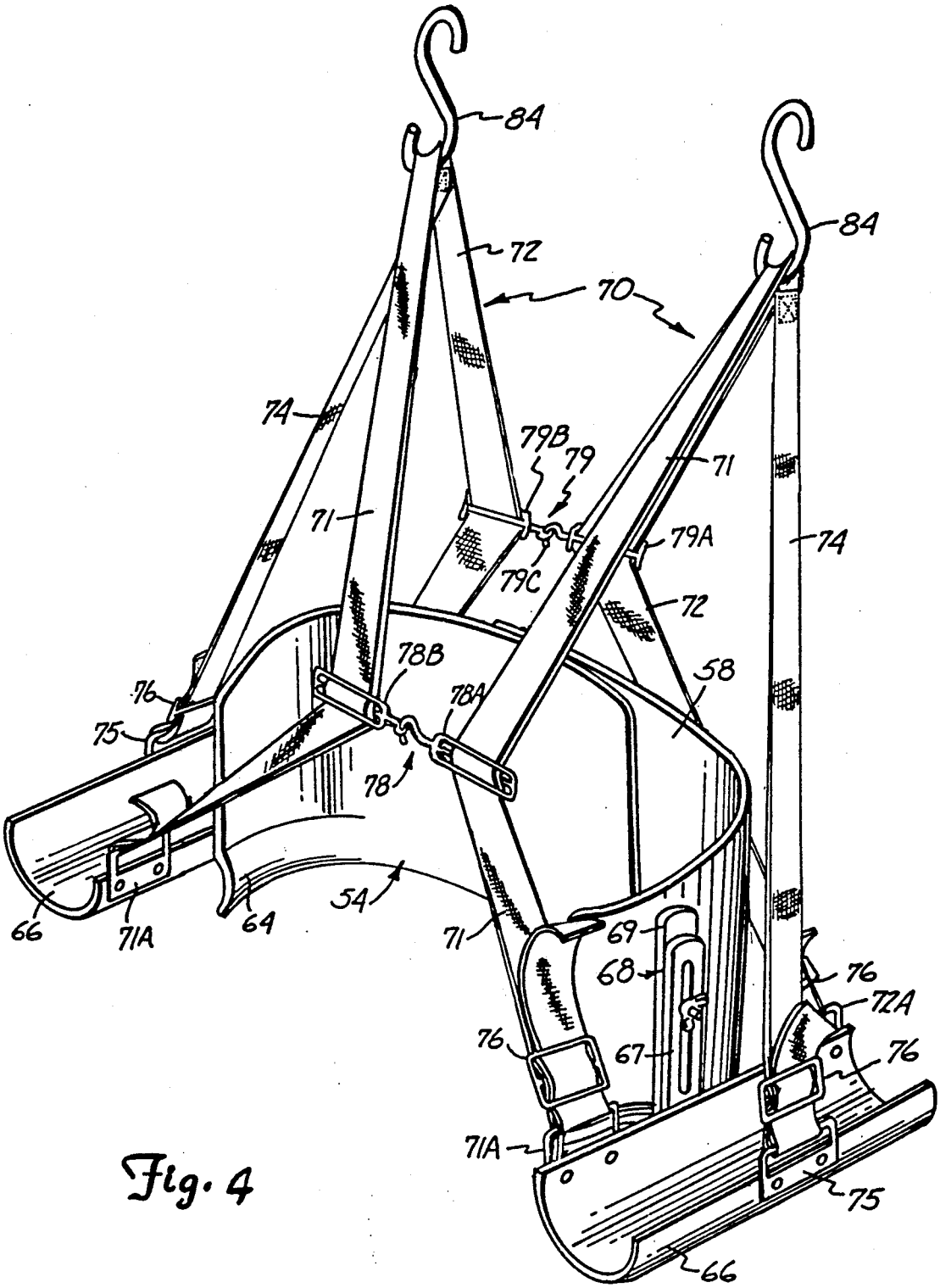
FIG. 4 is a perspective view of a preferred second embodiment of the present invention.

The upright gravity lumbar traction device made according to a second form of the present invention is indicated generally at 50 in FIG. 4. As perhaps best seen in FIG. 4, the device 50 comprises a hard shelled vest portion 54, which as shown is made into two shell exterior vest sections 56 and 58 that fit around the sides of the body of a wearer or patient near the lower portions of the rib cage. The vest sections 56 and 58 encompass the back and sides of the patient but leave the front open to allow the chest cavity to expand anteriorly for increased comfort and better breathing. The vest portion 54 is made to generally follow the contour of the patient's thorax 52A, and friction between the inner surface of shell portion 54 and the patient's skin will provide additional support and prevent the patient 52 from slipping down during treatment. Also, the unlined surface remains comfortable, but if desired, a thin lining may be added.

Figure 6:
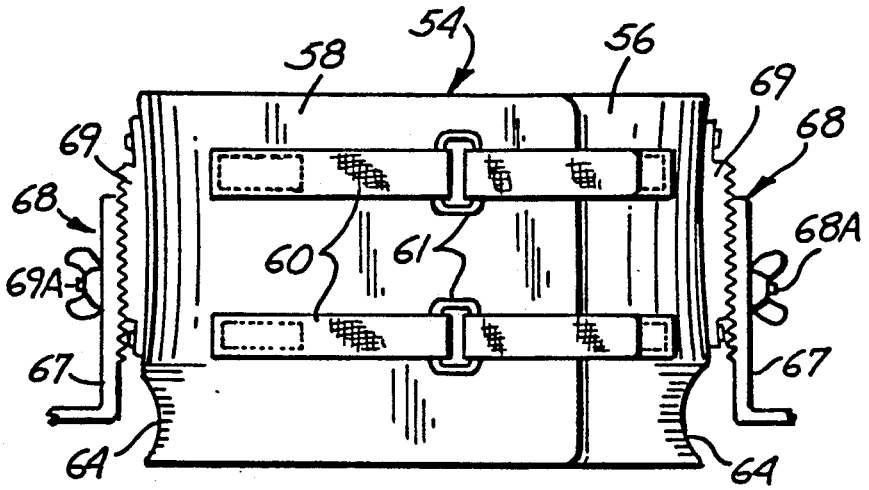
FIG. 6 is a rear view of the device of FIG. 4.

The two vest shell sections 56 and 58 can be adjustably connected at the rear, as shown in FIG. 6, by adjustable suitable connecting means shown at 60, such a pair of adjustable two piece straps each having its end fixed to the respective vest shell section and held together with a divided ring or buckle. Hook and loop fasteners sold under the trademark VELCRO may be used for adjusting the length of one or both straps if desired. The mating strap sections are looped through the buckle and folded back on the enclosures and held with the VELCRO fasteners. Adjusting the straps 60 will increase or decrease the size of the vest portion 54 to accommodate different size thoraxes of different patients.

The shell sections 56 and 58 may be made of a molded inflexible or rigid plastic, such as polypropylene and may be lined with a suitable thin foam liner 62, as stated, which has suitable frictional properties so that the patient 52 does not slip downward during treatment. The vest portion 50 further supports the patient 52 by having small inwardly protruding ridges as shown at 64 which are located at the sides of the lower edge part of each of the shell sections 56 and 58 to provide support just below the user's rib cage.

Arm supports or arm rests 66 are attached to the sides of each of the vest sections 56 and 58 by an adjustable connector assembly 68 which allows vertical adjustment of the arm supports for accommodating different size patients. The arm supports 66 comprise generally fore and aft elongated trough shaped members which allow the patient 52 to rest his forearms 52C therein with his elbows bent during treatment. By doing so, the patient 52 may support a portion of his weight through his forearms 52C and shoulders 59B and instead of having the weight supported entirely by the vest portion 54. The trough-shaped members 66 are fixed to a horizontal leg of a first bracket 67 of the adjustable connector 68 which has an upright leg that has serrations or teeth which interfit with teeth on a base bracket 69 of the connector 68. Base bracket 69 is fixed to the side of the respective vest shell 56 and 58. The interfitting teeth, positively position the arm supports 26 and a bolt 69A and wing nut are used to hold the base bracket 69 and first bracket 67 assembled. The upright leg of first bracket 67 has a slot receiving bolt 69A and which permits this adjustment near the center.

Figure 7:
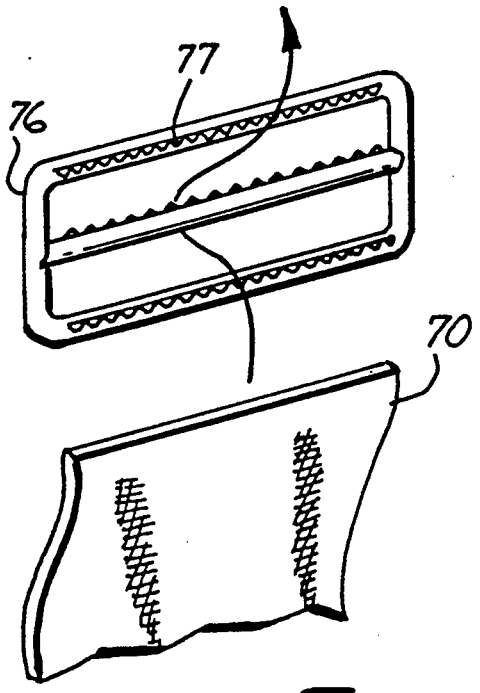
FIG. 7 is an exploded perspective view of a typical non-slip clamp used for retaining the support straps of the present invention to prevent them from slipping once they are positioned.

The vest portion 54 and arm supports or rests 66 are supported by a pair of straps shown generally at 70, which extends above the user. The straps 70 attach to the arm supports 66 and not to the vest portion at all. The straps include front strap portions 71 on which connect to each arm support 66 at a forward end of each respective arm support. The strap portions 71 are thus spaced forwardly of the patient 52 so as not to touch the patient's chest or impede breathing. The strap sections 71 each loop through a respective ring 71A on the respective arm support 66 and the front strap sections 71 are adjustably held by adjustment buckles 76 (formed as shown in FIG. 7) formed to have teeth that prevent the straps from slipping during use. Other standard, non-slip fastener rings or buckles also can be used for buckles 76. Many fastener rings or buckles have a toothed sliding bar on the buckle that slides to tighten on a strap. These non-slip buckles are used on helmets and on various tie-down straps.

Rear strap sections 72 are connected in a like manner to rings 72A, respectively, which are fixed to the rear ends of the arm supports 66 and the rear strap sections are spaced from the back of the patient so as not to pinch the back of the patient during treatment. The strap sections 72 are looped through rings 72A and are adjustably held with non-slip buckles 76 as well. Side strap sections 74 have upper ends fixed (sewed or riveted) near the top of the rear strap sections 72.

The other ends of strap sections 74 are connected to the arm supports 66 respectively at the outer edge and centered on the arm support so as to pull the arm supports 66 upwardly thereby allowing the weight placed on the arm supports to be distributed to the supporting straps rather than back to the sides of the chest, or thorax, which would increase side loading on the chest. The strap sections 74 are looped through rings 75 that are fixed to the outer edges of the arm supports 66. The strap sections 74 are also adjustably held by buckles 76.

The buckles 76 are used for adjusting the straps and have gripping teeth as can be seen typically in FIG. 7 which bear against the respective straps to prevent slippage during treatment and maintain an optimum treatment position.

Figure 9:
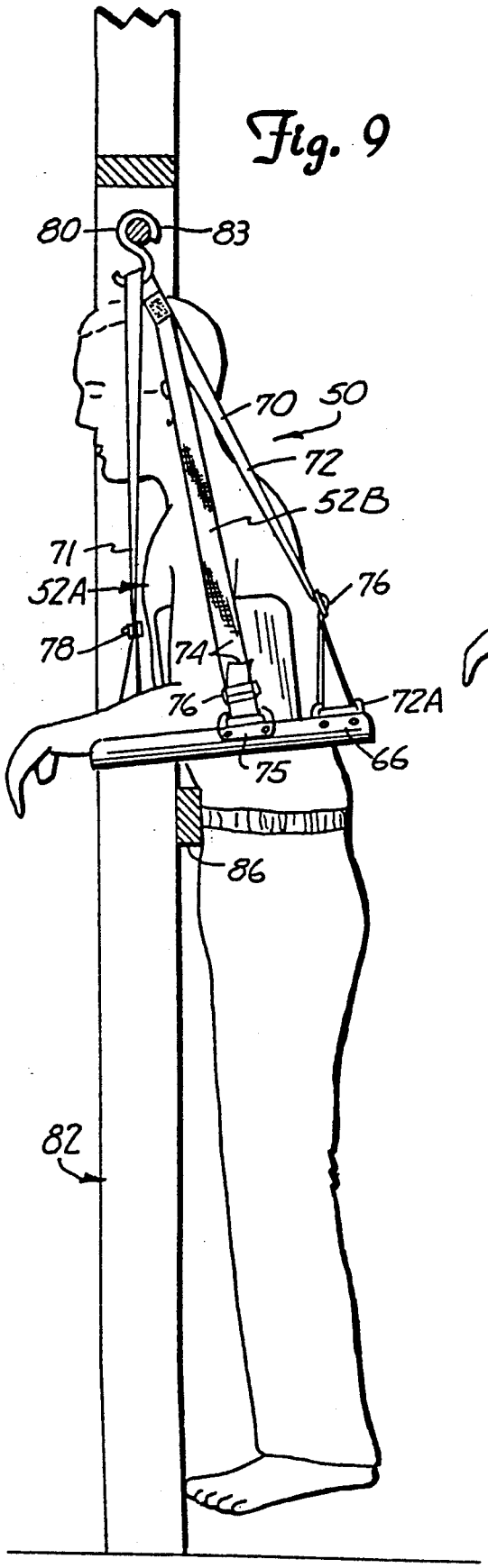
FIG. 9 is a side elevational view with parts of section and parts broken away showing the device in FIG. 8 in a position suspended from a bar and placing the user off center from the normal center of gravity.

The front strap sections 71 are held together in front by a quick release connecting latch or hook assembly 78. The latch or hook assembly 78 can be any desired design, but as shown has a strap buckle 78A with a hook on it on one strap section 71 and a strap buckle 78B and a hook receptacle on the other strap section 71. The parts of the latch or hook assembly 78 can be adjusted up or down on the strap sections 71 to change the load angles when supporting a patient. The buckles 78A and 78B used also are non-slip buckles having teeth as shown in FIG. 9. The hook on buckle 78A can be released from the receptacle to allow a patient 52 to quickly get out of the vest during treatment if needed, even under some load. The latch assembly 78 could be a quick release seat belt buckle also. When placing the vest on, the latch assembly 78 is loose or unhooked until the vest is in place and then the latch assembly 78 is hooked up. The rear strap sections 72 also are held together with a fastener system 79 including adjustable, connectable buckles 79A and 79B on the respective strap sections 72. The buckles 79A and 79B comprise center bar buckles that can be adjusted along the strap sections, but which have teeth to positively hold the buckles in position.

A releasable hook system 79C is used to join the buckles or rings 79A and 79B to hold the rear strap sections at a desired angle of support or loading. The hook system 79C does not have to be a quick release system and the buckles 79A and 79B can be fixed together with a permanent cross bar at position 79C.

Sliding the buckles or rings 79A and 79B along strap sections 72 results in changing the loading angle on the arm supports 66 at the rear, and thus changes the loading pressures on the vest portion 54 to insure comfort and adequate support. The vertical position of the fastener assemblies 78 and 79 determines the inward loading of the best sections and also adjusts the fit. By adjusting the position of the fastener assemblies 78 and 79, the loads on the thorax can be varied.

Figure 8:
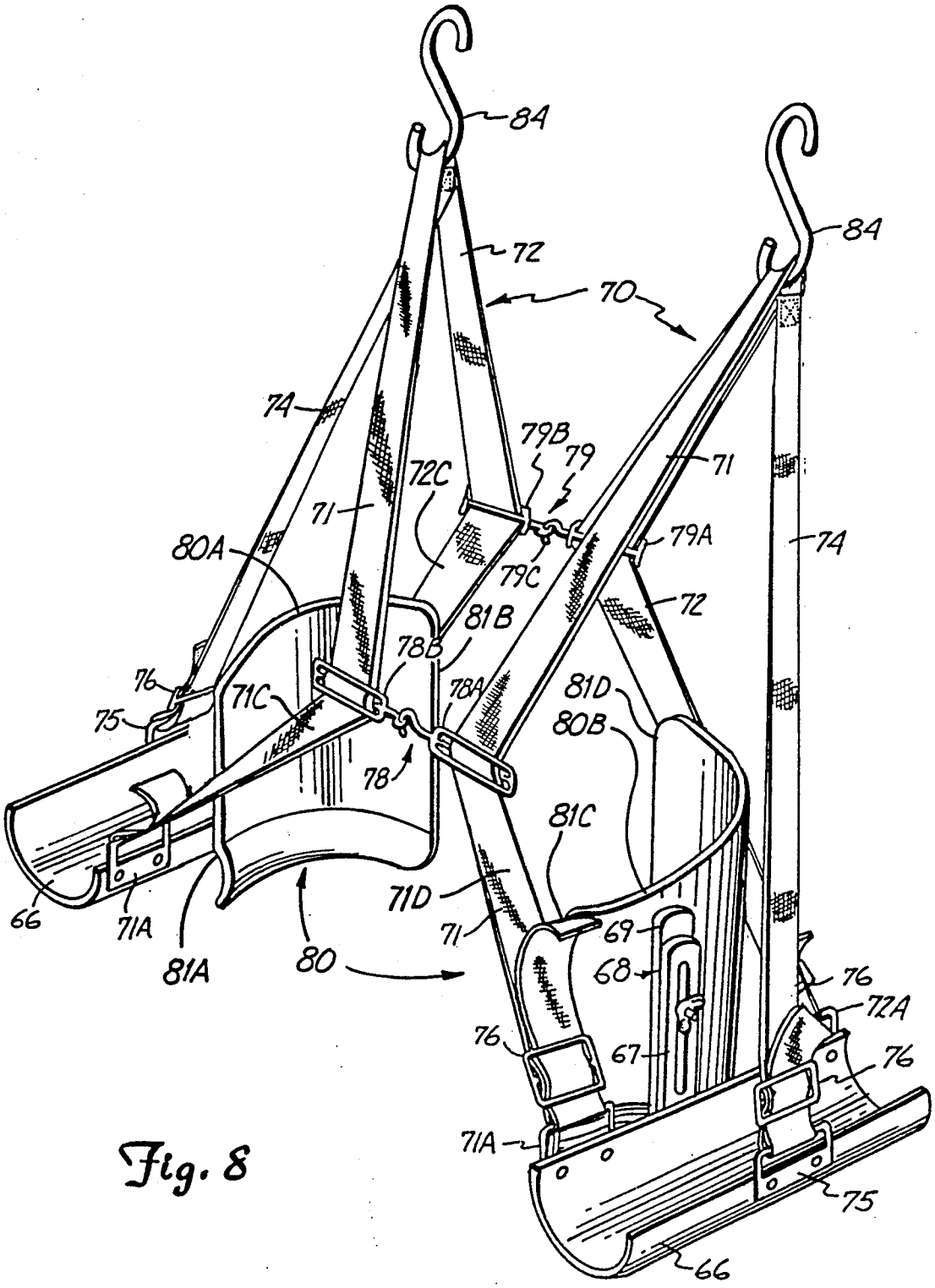
FIG. 8 is a perspective view of a third preferred embodiment of the present invention.

In FIG. 8, a further modified form of the invention is shown, and comprises a preferred embodiment of the present device. The vest's sections in this particular form of the invention are modified, and instead of only having one side open, that is, the anterior side of the thorax, the embodiment in FIG. 8 provides for a vest structure and support structure that does not have any fitting connections between the vest sections other than through the supporting straps. Straps between the sections can be used to hold the sections in assembly for ease of entry and exit, but the straps are not needed for support.

The supporting straps are numbered exactly as those shown in FIG. 4, in that they are operated in the same way and provide an inwardly directed force at both the front and rear of the vest in the same manner. In this particular form of the invention vest 80 comprises a pair of vest sections 80A and 80B, which are right and left hand shell sections that are formed generally to contour around only a portion of each side of a thorax of a user respectively. Front edge portion 81A on the right side vest section 80A and rear edge 81B of the right side section terminate so that they only partially curve around the sides of the thorax of the user. Left side vest section 80B has front edge portion 81C and the rear edge portion 81D formed again so that they are spaced from the edges 81A and 81B, respectively. The corners of the vest sections are rounded, and a formed lower portion can be made in the manner of the upwardly directed portion 64 shown in FIG. 4.

The support strap sections, including the sections 72C and 72D of the rear straps 72 between the buckles 79A and 79B and the supports 72A along with the straps 71, including the strap section 71C and 71D between the buckle assembly 78 and the supports 71A on the troughs 66 provide for an inward action that tends to move the vest sections 80A and 80B inwardly toward the user, and provide for a support retaining inward pressure for supporting the user when the vest sections are suspended through straps 71 and 72. The vest sections can move apart and expand and contract with the thorax of the user, just as they can when only one side, namely the front side is open.

Figure 10:
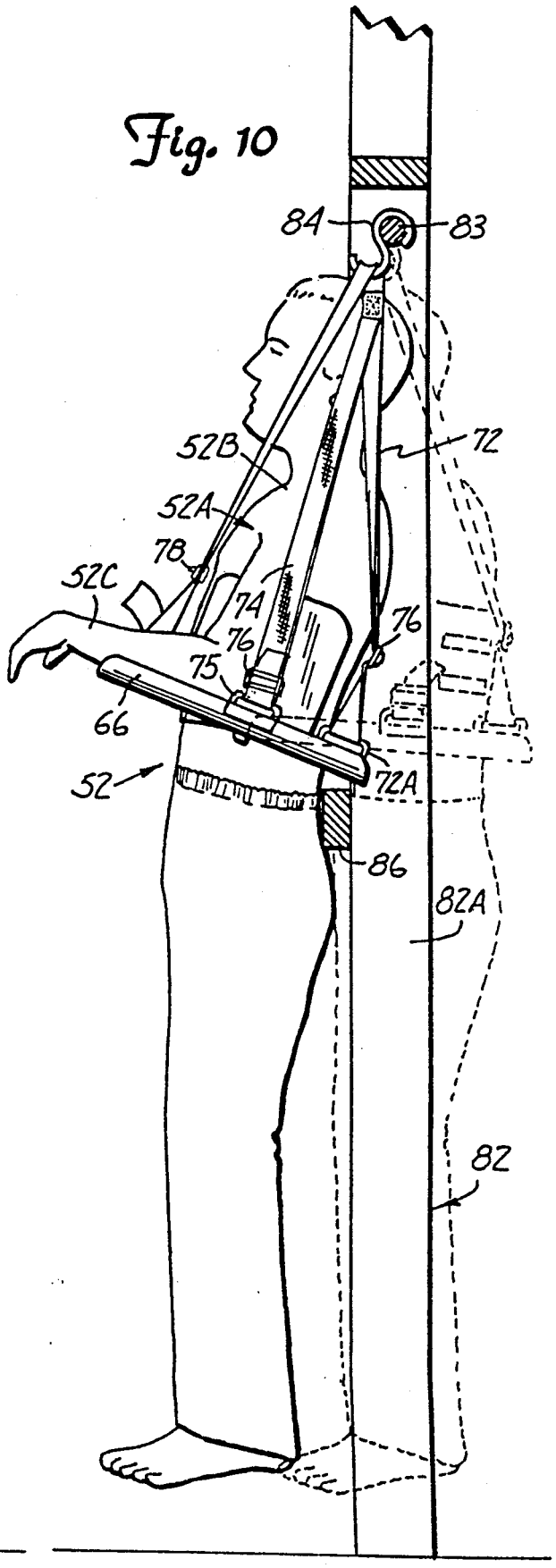
FIG. 10 is a view of a patient suspended in the device of FIG. 8 in a different working position from FIG. 9.

The treatment device may be used in the home by supporting it on a bar 83 supported in a door frame 82 (See FIGS. 9 and 10). The straps 70 are connected to the bar 82 by "S" hooks 84 that hook onto the straps 70 and over the bar 83. During treatment, if desired, a board or cross bar 86 may be placed between the patient 52 and the spaced vertical side members 82A of the door frame 82. The board 86 is long enough to span the door frame and may be placed in the front or the back of the patient 52 and against the door frame 82 depending on the loading angle desired. This support arrangement changes the support angle to aid in treatment, depending on the disorder being treated. The change in support angle can be adjusted with differently sized cross bars and different vertical offset positions. The board or bar 86 may also be moved up or down from the positions shown to further increase or decrease the angle at which the patient is supported relative to vertical.

Of course, the board or bar 86 also can be removed to permit the patient to be supported vertically. When supported in a frame 82, the patient 52 should be at a height which allows the toes to touch the floor when the foot is bent down so that weight is not necessarily continuously supported by the vest portion 80 and through the arms and shoulders. This allows the patient 52 to receive intermittent treatment (by putting the toes on the floor to support some weight) which may be preferred and also allows the patient to get into and out of the vest portion while it is suspended, without aid from others. Weights, as shown in the first form of the invention, may also be placed around the patient's ankles to increase the traction force during treatment as shown in the first form of the invention.

Figure 11:
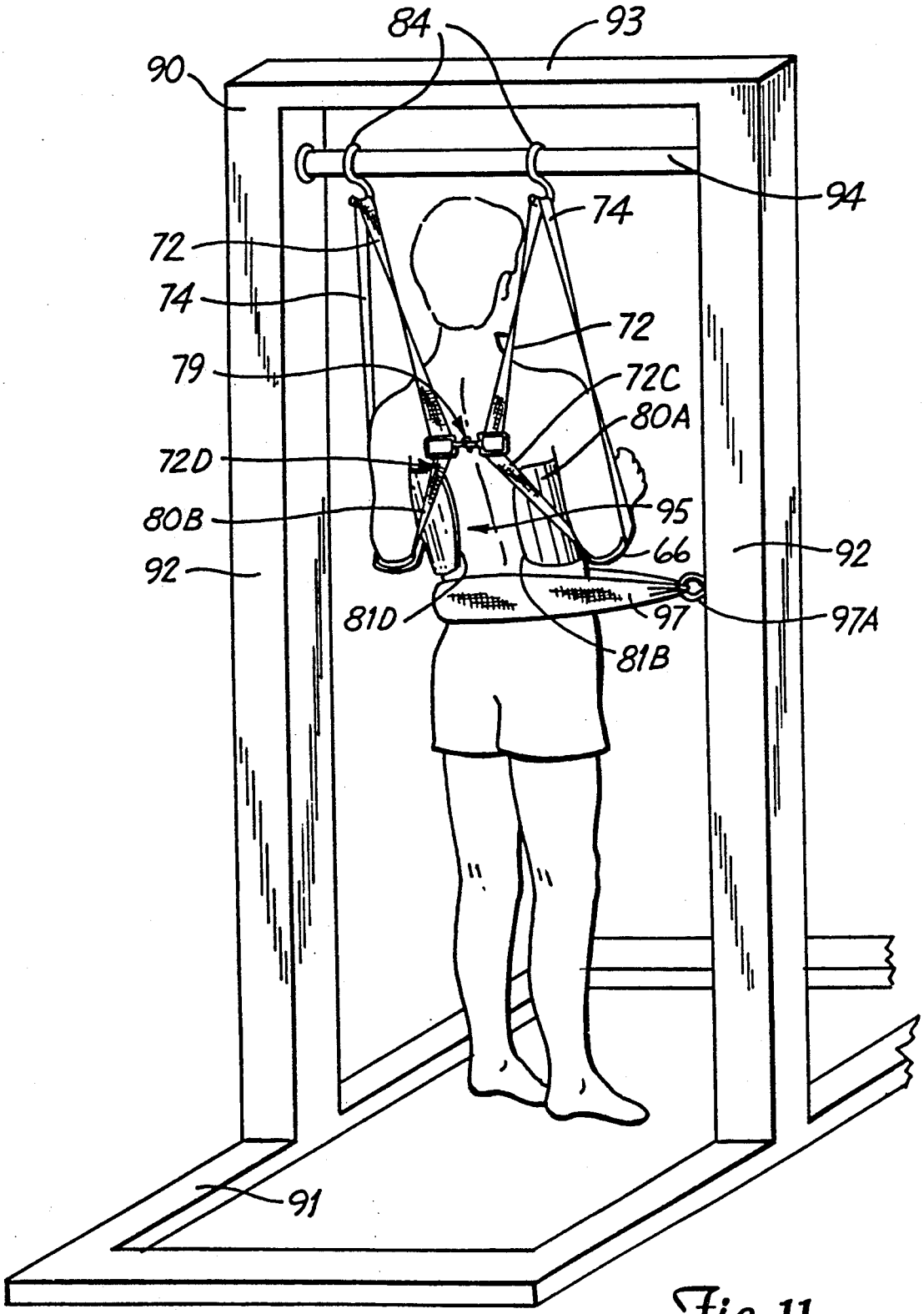
FIG. 11 is a rear view of a patient held laterally of a straight down suspended position using a vest as shown in FIG. 8.
Figure 12:
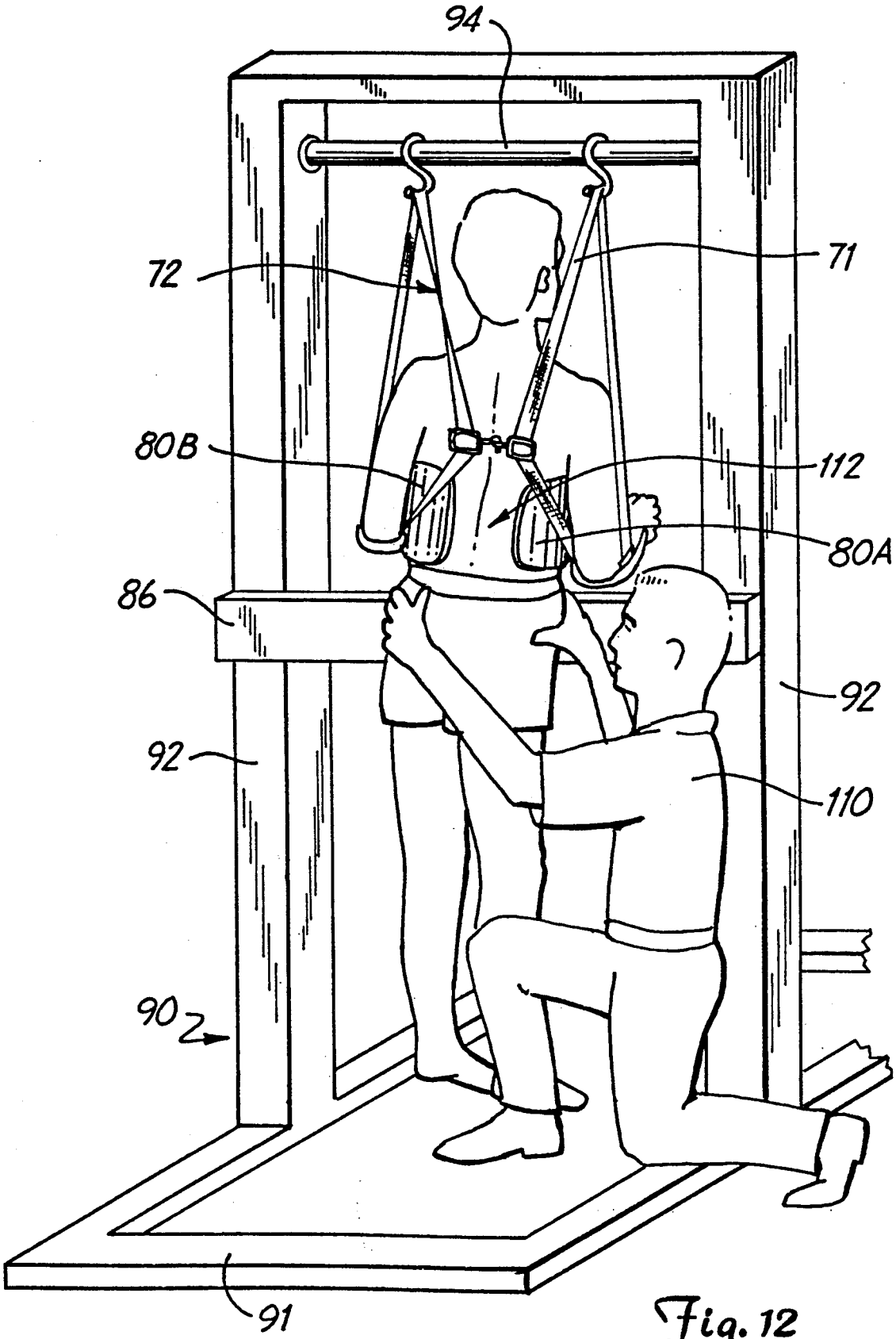
FIG. 12 is a rear view of a patient in a vest as shown in FIG. 8 suspended in position for receiving therapeutic manipulation or mobilization in a treatment regime.

In FIGS. 11 and 12, the form of the vest shown in FIG. 8 is illustrated in connection with a patient 52 and supported on a portable frame. The frame indicated generally at 90 comprises a stand 91 that supports the frame on the floor and provides stability in fore and aft direction. The frame 90 has a pair of upright columns 92 that are supported with a crossbar 93 across the top. A support crossbar 94 corresponds to the crossbar 83 and is fastened in place between the uprights, 92,92. The hooks 84 are used with the support straps 71, 72 and 74 connected to the arm gutters 66 on the vest sections 80A and 80B. In this form of the invention, the patient or subject 52 has the vest sections 80A and 80B positioned on the thorax and the subject's arms are supported in the arm gutters 66 as before. The rear edges 81B and 81D are shown in FIG. 11 to show that there is an open space 95 between the vest sections so the patient's spine is accessible for manipulation therapy while the patient is supported.

In this form of the invention, a lateral support band 97 is wrapped or looped around the subject, approximately at the waist, and is supported laterally to one of the uprights 92 to provide a slight lateral offset position for the patient, that is different from the gravitational free suspended position of the patient, to aid in treating and correcting lateral curvatures or offsets of the spine.

FIG. 12 shows the same structure as FIG. 11, but with a patient positioning crossbar 86 shown in position bearing on the uprights 92. The vest sections 80A and 80B again are shown on a patient, and a therapist 110 is shown in a position to manipulate the joints and muscles of the patient 52. FIG. 12 illustrates that the spacing between the edges 81C and 81D of the vest sections 80A and 80B provide access to the spine in the region indicated at 112.

The therapist 110 can observe external configurations quite easily and can apply weight to the hips as shown or move the hips to gain alignment as desired.

Since there is no table at the back of a patient the therapist can manipulate the back and the pelvis during traction, and modalities such as superficial heat, ultrasound, ice coolant sprays can be applied directly to the spine during traction to improve relaxation.

As shown in FIGS. 9, 10 and 11, the patient can be placed in flexion, extension or lateral flexion, and even rotation (by twisting the lower extremities relative to the upper body) while being suspended under gravity traction utilizing the vest of the present invention. If maintenance traction is needed, the patient can be sent home with a vest and a simple chin-up bar for supporting the vest.

In the devices shown in FIGS. 9 through 12, the traction can be accomplished intermittently by lifting the toes on and off the floor, and the suspension can be adjusted vertically so this action can be accomplished quite easily.

The present device permits applying the desired amount of force, and either intermittent, or sustained traction can be accomplished easily.

Figure 5:
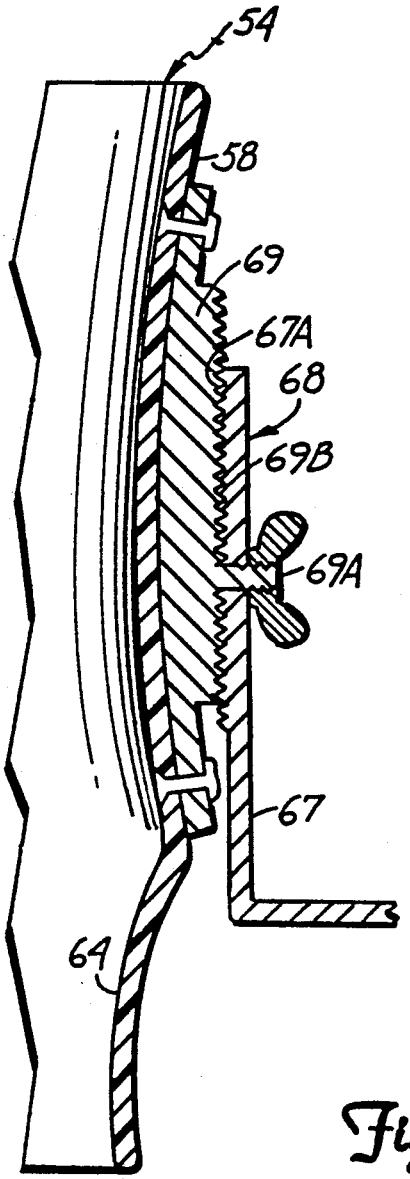
FIG. 5 is a fragmentary vertical sectional view of a bracket for holding a typical arm support used with the device of FIG. 4.

The patient controls loads through the arm supports or arm rests 66 as well, and can regulate loads for comfort and for breathing ease. The vest portions shown in FIGS. 4, 5, and 6 and in FIG. 8 do not load in a manner that pinches or constricts the chest. The molded roll or ridge at the bottom edge of the vest sections also aids in comfortable support.

The ability to support the body through the forearms, and the ability to support the body on the toes as desired permits the patient to actually lift the body slightly from the vest to permit a "breather" and to allow for full chest expansion whenever desired. By suspending the patient so that only the toes reach the ground, merely lifting the toes will initiate traction. Thus, the knees and hips do not need to be flexed for floor clearance and therefore the suspension allows better relaxation of the leg and trunk muscles. The patient's weight is relieved by lowering the toes. Safety devices to provide for release of the supports can be provided to release the patient if the patient falls asleep, develops a cramp or if other emergencies arise.

The rigid shell vest provides firm support of the body parts at the sides and back rather than circumferential compression of the chest as with prior art cloth vests.

Basically the therapeutic effects of lateral bending utilizing a sling or strap as shown in FIG. 11, and fore and aft bending, comprising flexion or extension, aids in treatment of spinal conditions that lead to lower back pain. The lateral bending can be reduced slowly after treatment by lengthening the band of 97, as can the fore and aft offset positions by changing bar 86. Padding can be used between the bar 86 and the patient for changing the offset positions in fore and aft directions. The lower part of the body is left hanging free most of the time during this traction type treatment utilizing the vest of the present invention, and the therapist can manipulate the lumbar region from the rear without interference from a table. The muscles are put in tension and the muscles relax under tension. There is no friction between the lower portions of the body ad a table, so that the movement of the lower portions of the body can be quite free and easy. Positional traction is thus attained, because the positions can be changed with the crossbar, or the lateral sling, and held while in traction. Manipulation or mobilization can be done while maintaining traction, and also while the subject is in a position that is not a free suspended position.

Connecting members for the straps are up above the area where manipulation is desired, and if desired suitable cross straps can be used between the vest sections across the tops for holding the sections together while getting into the vest. Velcro Fasteners can be used. The ability to visualize the position of the spine is available with all forms of the invention, without utilizing a table. Palpitation of the entire spine can be carried out while in traction. Moving the crossbar 86 up and down can change the angle of suspension of the lower portions of the body as well, and the support 97A for band 97 can be adjustable to change the lateral angle.

Although the present invention has been described with reference to preferred embodiments, workers skilled in the art will recognize that changes may be made in form and detail without departing from the spirit and scope of the invention.

What is claimed is:

1. A gravity lumbar traction device comprising a vest structure to support a user adjacent the thorax, the thorax having an anterior side and a width, strap means to support the vest structure to in turn support a user thereof through the vest from a support above the user, the vest structure comprising a two vest sections of a rigid material shaped to generally follow contours to the sides of the user's thorax to distribute weight over an area of the vest structure, the vest sections being separated and open across substantially the entire width of the anterior side of the thorax for allowing the thorax to expand anteriorly without having the anterior side of the thorax contact the vest, said strap means including a pair of front support straps which are fastened to support respective fronts of the vest sections and positioned to the front of a user and which extend upwardly, means to couple the front straps together at the front of a user so the front straps converge from the vest sections upwardly for utilizing a portion of the support force to urge the vest sections together, and a pair of rear support straps which are fastened to support rear edges of the respective vest section, and positioned to the rear of a user, and which extend upwardly, means to couple the rear straps together at the rear of a user so the rear straps converge from the vest sections upwardly for utilizing a portion of supporting force to urge the vest sections together.

2. A gravity lumbar traction device according to claim wherein no fastening means for the vest sections extend across at least the anterior side of the thorax other than the front support straps.

3. The gravity lumbar traction device of claim 1 wherein there are no fasteners for the vest sections across the posterior side of the thorax other than the rear support straps.

4. The gravity lumbar traction device according to claim 1 including a support bar positioned overhead of a user of the traction device means to support the strap means from the support bar so that there are tension forces in the strap means, and the means to couple the front straps together and the means to couple the rear straps together causes the tension forces have a lateral component urging the vest sections inwardly toward the sides of a user.

5. The gravity lumbar traction device of claim 1 and means for varying the supported angle of a user of the vest when supported from an overhead bar to alter the forces of gravity on such user.

6. The apparatus as specified in claim 5 wherein said means for varying comprises a cross bar to engage the user and to offset from position the user of the normal free suspension position of such user.

7. The gravity lumbar traction device of claim 1 wherein said means for adjusting the position of a user of the vest when supported on a cross bar comprises means for laterally positioning the user relative to the free supported position of such user.

8. The gravity lumbar traction device of claim 1 and means for altering the position of a user comprising a crossbar that engages the user of the vest at a position below the vest to alter the free supported position of such user.

9. The gravity lumbar traction device of claim 1 wherein said means to couple the front straps together comprises a quick release means for aiding in removing the vest sections.

10. The gravity lumbar traction device of claim 1 including arm gutter means for supporting the forearms of a user of the vest, said arm gutters having inner edges that support the front and rear straps directly thereon.

11. A gravity lumbar traction device comprising a vest structure to support a user adjacent the thorax, the thorax having an anterior side and a width, gutter means mounted rigidly on each of the vest sections for supporting the arms of a user; strap means connected to the gutter means at location spaced laterally from the vest structure to support the vest structure and to in turn support a user thereof through the vest from a support above the user, the vest structure comprising two separate vest sections of a rigid material shaped to generally follow contours to the sides of the user's thorax to distribute weight over an area of the vest structure, the vest sections being spaced and open across substantially the entire width of the anterior side of the thorax for allowing the thorax to expand anteriorly without having the anterior side of the thorax contact the vest, said strap means including a pair of front support straps which are fastened to support respective fronts of the gutter means and vest sections and positioned to the front of a user and which extend upwardly, first means to couple the front straps together at the front of a user so the first straps converge from the gutter means upwardly for utilizing a portion of the support force to urge the vest sections together, and a pair of rear support straps which are fastened to support rear portions of the gutter means and positioned to the rear of a user, and which extend upwardly, second means to couple the rear straps together at the rear of a user so the rear straps converge from the gutter means upwardly for utilizing a portion of supporting force to urge the vest sections together.

12. A gravity lumbar traction device according to claim 11, wherein the converging front and rear straps comprise the sole means for urging the vest sections laterally toward a user.

13. The gravity lumbar traction device of claim 12 wherein the first and second means to couple the front and rear straps together are adjustable along the straps to change an angle of convergence of each of the straps from the respective gutter means.

14. The gravity lumbar traction device of claim 11 wherein said first means to couple the front straps together comprises a quick release means for aiding in removing the vest sections.

15. A method of providing gravity lumbar reduction comprising the steps of:

supporting a user in a vest, the vest including members capable of permitting a user to support part of the user's weight through the user's arms and shoulders and encompassing at least a portion of the user's thorax on an overhead support so the user is suspended in a substantially upright position with respect to a supporting surface at a height such that a user's feet clear the supporting surface with the user's legs straight in at least one position of the user's feet, the height of the support being such that the user's feet can be moved to a position to partially or fully support the weight of the user.

16. The method of claim 15 and including the step of at least periodically supporting the weight of the user through the user's arms and shoulders to relieve gravity loads between the user's thorax and the vest.

17. The method of claim 15 including the step of intermittently supporting the user's weight on the floor to remove traction forces and to relieve gravity loads between the user's thorax and the vest as needed.

18. The method of claim 15 including the step of supporting the user such that the angle of suspension of the user is changed from a vertical position, to change the angle of traction forces acting on the user.

19. The method of claim 15 including the step of manipulating portions of the body of a user while supported in the vest.

20. The method of claim 19 including the step of providing a vest having vest sections with edges that are spaced apart and manipulating the body of a user between the spaced apart edges of the vest.

21. The method of claim 19 including the step of providing a vest having vest sections with edges that are spaced apart at the rear of the user and palpitating and manipulating rear lumbar portions of the body of a user between the vest sections.

* * * * *

UNITED STATES PATENT AND TRADEMARK OFFICE

CERTIFICATE OF CORRECTION

PATENT NO. : 5,033,460

DATED : July 23, 1991

INVENTOR(S) : Gary D. Goldish

It is certified that error appears in the above-identified patent and that said Letters Patent is hereby corrected as shown below:

Col. 10, line 29, delete "claim", insert --claim 1--.

Signed and Sealed this

Fifteenth Day of December, 1992

*Attest:*

DOUGLAS B. COMER

*Attesting Officer*

*Acting Commissioner of Patents and Trademarks*